US005997662A

United States Patent [19]

Norio

[11] Patent Number: 5,997,662

[45] Date of Patent: Dec. 7, 1999

[54] SURFACE-HARDENED CHAIN LINK

[75] Inventor: Kanetake Norio, Tokyo, Japan

[73] Assignee: Metal Technic Research Laboratory, Tokyo, Japan

[21] Appl. No.: 08/993,979

[22] Filed: Dec. 18, 1997

[30] Foreign Application Priority Data

Dec. 18, 1996 [JP] Japan ..... 8-338015

[51] Int. Cl.[6] ..... C22C 38/02; C22C 38/04

[52] U.S. Cl. ..... 148/319; 148/330; 148/336

[58] Field of Search ..... 148/319, 330, 148/336

[56] References Cited

FOREIGN PATENT DOCUMENTS

| | | | |
|---|---|---|---|
| 45-28114 | 9/1970 | Japan | 148/330 |
| 54-32091 | 10/1979 | Japan | 148/319 |
| 61-276956 | 12/1986 | Japan . | |

*Primary Examiner*—Deborah Yee

*Attorney, Agent, or Firm*—Baker & Botts, L.L.P.

[57] ABSTRACT

A surface-hardened chain comprises a plurality of connected chain links, each of which links is made from a killed steel having a specified chemical composition and comprises a surface-hardened layer of a high carbon tempered martensite structure and a core layer of a low carbon tempered martensite structure.

5 Claims, 5 Drawing Sheets

SURFACE-HARDENED CHAIN LINK

BACKGROUND OF THE INVENTION

1. Field of the Invention

This invention relates to a surface-hardened chain used as a load chain of an electric chain block or a pneumatic chain hoist, a chain of a chain conveyor or the like.

2. Description of Related Art

In this type of the chain, it is required to have higher wear resistance and fatigue resistance because a very large loading is applied to the chain and the frequency in use is high. And also, it is required to have higher strength and toughness because an impact load is applied to the chain. In the conventional chain, therefore, there has been used a surface-hardened chain link formed by subjecting a chain link to gas carburizing, quenching and tempering treatments.

As sectionally shown in FIG. 3, such a surface-hardened chain link is composed of an outermost surface layer 10, a hardened layer 11 enclosed with the outermost surface layer 10 and having a high carbon tempered martensite structure, and a core portion 12 enclosed with the hardened layer 11 and having a low carbon tempered martensite structure.

In the conventional surface-hardened chain, Mn-B steel (SAE15B24), Ni-Cr-Mo steel (JIS SNCM220, SAM8620), Ni-Mo steel (SAE4620), Ni-Cr-Nn-Mo-B steel (see JP-A-61-276956) and the like were generally used as a starting material.

However, the surface-hardened chains made frrm these starting materials were insufficient in the wear resistance, fatigue resistance, strength and toughness as mentioned below.

In the surface-hardened chain made from Mn-B steel, Ni-Cr-Mo steel, Ni-Cr-Mn-Mo-B steel or the like, oxidation at crystal grain boundary (intergranular oxidation) was caused in a surface layer of a chain link by gas carburizing, so that the wear resistance and fatigue resistance in the surface layer were considerably deteriorated to bring about the premature degradation of the surface layer and also the strength and toughness were poor.

In the surface-hardened chain made from Ni-Mo steel, retained austenite was existent in the surface layer and hence the wear resistance and fatigue resistance in the surface layer were considerably deteriorated to bring about the premature degradation of the surface layer and also the toughness in the surface layer was low.

SUMMARY OF THE INVENTION

It is, therefore, an object of the invention to provide a surface-hardened chain having no intergranular oxidation in its surface layer and being minute in austenite crystal grain size and excellent in the wear resistance, fatigue resistance, strength and toughness.

According to the invention, there is the provision of a surface-hardened chain comprising a plurality of connected chain links each made from a killed steel having a chemical composition comprising C: 0.17–0.35 wt %, Si: 0.10–0.25 wt %, Mn: 0.40–0.80 wt %, P: not more than 0.020 wt %, S: not more than 0.020 wt %, Ni: 0.40–1.5 wt %, Mo: 0.15–0.60 wt %, B: 0.0005–0.006 wt % and the balance of Fe, said chain link cmprising a surface-hardened layer of a high carbon tempered martensite structure and a core layer of a low carbon teeeered rartensite structure.

In preferable embodiments of the invention, a surface layer portion of the surface-hardened layer has a metal structure having no intergranular oxidation, and an austenite crystal grain size of the chain link is fine, and a carbon content of the surface-hardened layer is a range of 0.6–0.8 wt %, or a range of 1.0–1.3 wt %.

BRIEF DESCRIPTION OF THE DRAWINGS

The invention will be described with reference to the acccmpanying drawings, wherein.

DESCRIPTION OF PREFERRED EMBODIMENTS

The reason why the chemical composition of the killed steel used in the chain link is limited to the above range is as follows.

When C content is less than 0.17 wt %, the hardenability lowers and the strength is insufficient, while when it exceeds 0.35 wt %, the toughness of the tempered martensite lowers.

As Si content becomes small, the toughness is improved, but when it is less than 0.10 wt %, the improving effect is not obtained, while when it exceeds 0.25 wt %, the toughness lowers.

When Mn content is less than 0.40 wt %, the hardenability and strength lower, while when it exceeds 0.80 wt %, the oxidation at the crystal grain boundary (intergranular oxidation) is undesirably caused.

As P content becomes smll, the toughness is improved, and also as S content becomes small, the toughness is improved, Therefore, upper limits of P content and S content are 0.020 wt %, respectively. Moreover, when B is existent at a low P content as mentioned below, the effect of preventing low-temperature temper embrittlement can be obtained by synergistic action of P and B.

When Mo content is within a range of 0.15–0.60 wt %, the improvement of toughness and wear resistance is obtained. However, when it is less than 0.15 wt %, the hardenability is not improved, while when it exceeds 0.60 wt %, poor weld is frequently created in the formation of the chain link.

When Ni content is less than 0.4 wt %, the hardenability is not improved, while when it exceeds 1.50 wt %, retained austenite is created in the hardened layer to cause temper embrittlement.

When B content is less than 0.0005 wt %, the hardenability and the above synergistic effect are not obtained, while when it exceeds 0.006 wt %, the hardenability and the synergistic effect are deteriorated. According to the invention, when B content is within a range of 0.0005–0.006 wt %, the strength at grain boundary is improved without causing the intergranular oxidation and hence the improvement of hardenability and toughness of hardened layer and the synergistic effect are obtained.

In the invention, the chain link comprising the surface-hardened layer of the high carbon tempered martensite structure and the core layer of the low carbon tempered martensite structure is advantageously obtained by subjecting the chain link of the killed steel to a treatment of carburizing—quenching—tempering or a treatment of carburizing—nitriding—quenching—temering.

The carbon content of the surface-hardened layer can properly be adjusted in these treatments. Therefore, it is ipportant to control the carbon content of the surface-hardened layer to a proper range in accordance with the desired properties or applications. For instance, the carbon content of the surface-hardened layer is favorable to be 0.6–0.8 wt % in applications requiring the toughness or 1.0–1.3 wt % in applications requiring the wear resistance.

The following examples are given in illustration of the invention and are not intended as limitations thereof.

Figure 1:
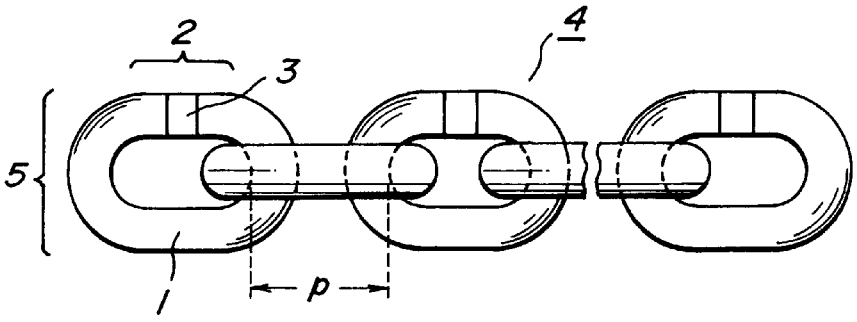
FIG. 1 is a diagrammatic view of a chain formed by connecting chain links to each other.
Figure 2:
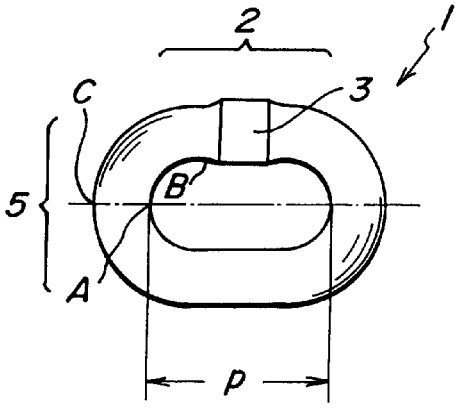
FIG. 2 is a diagrammatic view of a chain link used in the chain of FIG. 1.

As shown in FIG. 1, a chain 4 is formed by bending a round bar of 7.1 mm in diameter having a chemical composition as shown in Table 1 to form a chain link 1 and connecting these link chains to each other at a pitch p of 21 mm and subjecting opposed ends of a parallel portion 2 in each of the chain links 1 to upset butt welding to automatically form a weld part 3. Therefore, these chain links 1 are successively engaged with each other at a shoulder portion 5. In FIG. 2 is shown one chain link 1 taken out from the chain 4. As shown in FIG. 2, a point A of the chain link 1 or a center of an inner face of the shoulder portion 5 in the chain link is a position of creating a maxamm wearing, and a point B in the vicinity of a borderline between the shoulder portion 5 and the parallel portion 2 is a position of creating maximum tensile stress, and a point C of the chain link 1 or a center of an outer surface of the shoulder portion 5 is a position of creating a second larger tensile stress.

TABLE 1

| Sample | | Chemical composition (wt %) | | | | | | | | |
|---|---|---|---|---|---|---|---|---|---|---|
| No. | Classification | C | Si | Mn | P | S | Ni | Cr | Mo | B |
| 1 | Mn—B steel 15B24 | 0.19 | 0.32 | 1.41 | 0.032 | 0.025 | — | — | — | 0.002 |
| 2 | SNCM220 SAE8620 | 0.21 | 0.26 | 0.85 | 0.028 | 0.026 | 0.51 | 0.63 | 0.15 | — |
| 3 | JP-A-61-276956 (Ni—Cr—Mn—Mo—B steel) | 0.22 | 0.25 | 1.56 | 0.025 | 0.075 | 1.56 | 0.65 | 0.15 | 0.0008 |
| 4 | SAE 4620 | 0.18 | 0.32 | 0.65 | 0.027 | 0.025 | 1.81 | — | 0.21 | |
| 5 | Ni—Mn—Mo—B steel | 0.18 | 0.16 | 1.0 | 0.031 | 0.025 | 1.30 | — | 0.12 | 0.0003 |
| 6 | Acceptable steel | 0.18 | 0.15 | 0.45 | 0.015 | 0.011 | 0.45 | — | 0.20 | 0.0015 |
| 7 | Acceptable steel | 0.18 | 0.15 | 0.45 | 0.015 | 0.011 | 0.45 | — | 0.20 | 0.0015 |
| 8 | Acceptable steel | 0.35 | 0.16 | 0.62 | 0.008 | 0.005 | 0.87 | — | 0.51 | 0.003 |
| 9 | Acceptable steel | 0.23 | 0.13 | 0.75 | 0.001 | 0.002 | 0.95 | — | 0.15 | 0.002 |

Each of the above chains of Sample Nos. 1–6 is subjected to a carburizing treatment in a gas carburizing furnace at a carburizing temperature of 900° C. using an endothermic converted gas (mixed gas of CO, $H_2$ and $N_2$) produced from methane (natural gas) and air as a carrier gas and methane (natural gas) as an enrich gas, and oil-quenched and then tempered at 200° C. The chain of Sample No. 7 is subjected to carburizing and nitriding at 880° C. by using an endothermic converted gas (mixed gas of CO, $H_2$ and $N_2$) as a carrier gas and methane (natural gas) and ammonia gas ($NH_3$) as an enrich gas, and oily-quenched and then tempered at 200° C. The chains of Sample Nos. 8–9 is subjected to a gas carburizing at 930° C. by using CO rich endothermic converted gas as a carrier gas and butane as an enrich gas, and oil-quenched and then tempered at 200° C.

The thus surface-hardened chains have properties as shown in Table 2, respectively. Moreover, the chains of Sample Nos. 1–5 (using the conventional steel material) have a depth of a total carburized-hardened layer of 0.3 mm and a surface carbon content $C_s$ in a surface layer portion of 0.8 wt %, respectively.

TABLE 2

| Sample No. | Classification | Austenite crystal grain size number | Stress creating cracks $\sigma_C$ (MPa) | Intergrannular oxidation in surface layer portion | Stress at breakage $\sigma_B$ (MPa) | Total elongation at breakage E (%) | Fatigue limit $\sigma_F$ (MPa) | Wear resisting ratio AW | Carbon content in surface layer portion $C_s$ (%) |
|---|---|---|---|---|---|---|---|---|---|
| 1 | Mn—B steel 15B24 | 5.2 | 520 | presence | 805 | 4.3 | 242 | 0.34 | 0.8 |
| 2 | SNCM220 SAE8620 | 4.8 | 457 | presence | 786 | 4.0 | 230 | 0.35 | 0.8 |
| 3 | JP-A-61-276956 (Ni—Cr—Mn—Mo—B steel) | 5.5 | 567 | presence | 805 | 4.5 | 242 | 0.39 | 0.8 |
| 4 | SAE 4620 | 5.3 | 574 | absence | 811 | 4.8 | 250 | 0.381 | 0.8 |
| 5 | Ni—Mn—Mo—B steel | 7.1 | 583 | presence | 835 | 8.6 | 267 | 0.392 | 0.8 |
| 6 | Acceptable steel (carburizing) | 7.5 | 720 | absence | 910 | 12 | 360 | 1.63 | 0.7 |
| 7 | Acceptable steel (carburizing-nitriding) | 7.5 | 750 | absence | 920 | 14 | 364 | 1.65 | 0.6 |
| 8 | Acceptable steel (curburizing) | 7.8 | 746 | absence | 980 | 14.5 | 384 | 1.84 | 1.2 |
| 9 | Acceptable steel (curburizing) | 8.5 | 737 | absence | 925 | 14 | 365 | 1.65 | 1.2 |

Figure 4:
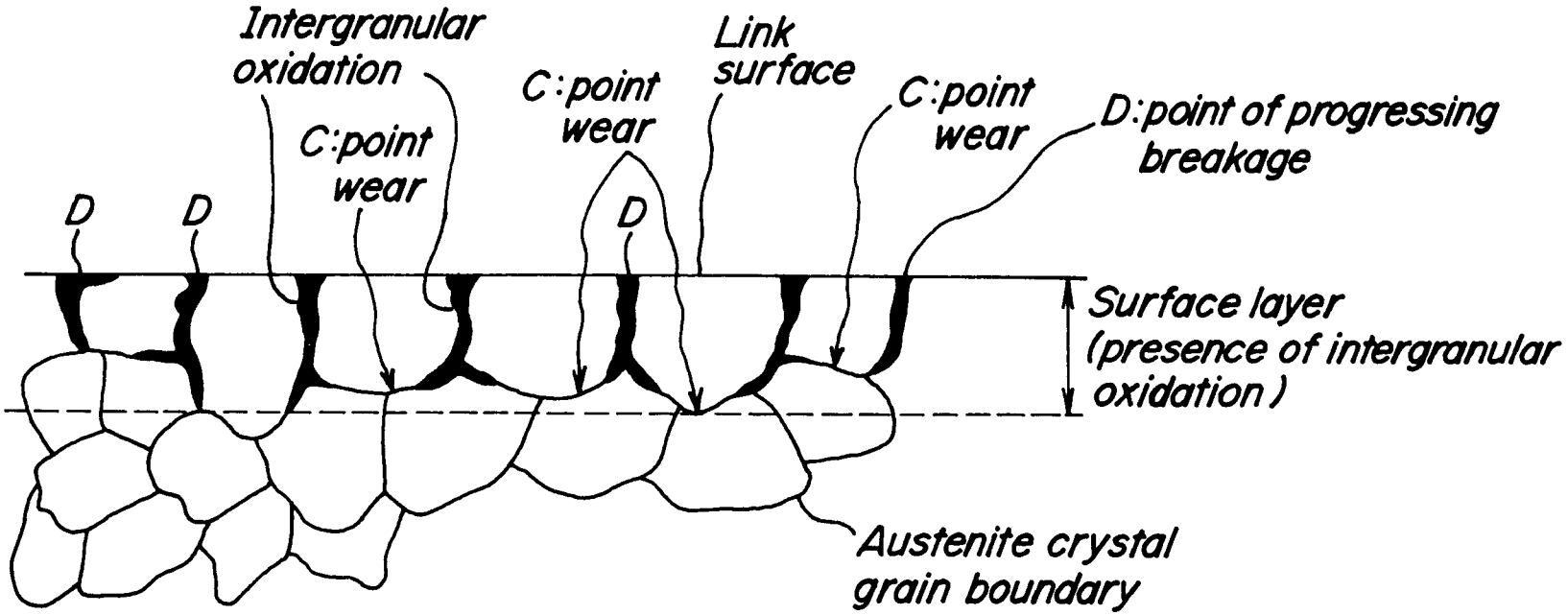
FIG. 4 PRIOR ART
FIG. 4 is a diagramatically enlarged section view of a structure in a surface portion of the conventional chain link.

In the chains of Sample Nos. 1–3, the oxidation at crystal grain boundary is created in an outermost surface layer as shown in FIG. 4 and the quenching is insufficient and the austenite crystal grain size number is 4.8–5.5 (the smaller the numerical value, the larger the grain size) and the strength and toughness are low. Furthermore, the level of the wear resistance AW is as low as 0.34–0.39 (the larger the numerical value, the better the wear resistance). And also, the fatigue limit $\sigma_F$ indicating the fatigue resistance is as low as 230–242 MPa (the smaller the numerical value, the lower the fatigue limit). Moreover, stress at breakage $\sigma_B$ indicating the strength 786–805 MPa and total elongation at breakage E indicating the toughness is 4.0–4.5%.

In the chain of Sample No. 4, the intergranular oxidation is not existent in the surface layer portion, but stress creating cracks $\sigma_C$ is as low as 574 MPa and the total elongation at breakage E indicating the toughness of the hardened layer is as low as 4.8%. Furthermore, retained austenite is existent in the hardened layer and the wear resisting ratio AW indicating the wear resistance is as low as 0.381.

In the chain of Sample No. 5, the austenite crystal grain size number is improved as compared with those of Sample Nos. 1–4, but the intergranular oxidation is existent in the surface layer portion and the other properties are substantially the same level as in Sample Nos. 1–4.

The chains of Sample Nos. 6–9 correspond to examples according to the invention. In these examples, it is common to provide the following results:

(1) There is no oxidation at crystal grain boundary (intergranular oxidation) in the surface layer portion.

(2) The austenite crystal grain size number of 7.5–8.5 is obtained by the grain size control in the steel-making, so that the resulting crystal grains are fine.

(3) The retained austenite is not existent in the surface layer portion.

Figure 3:
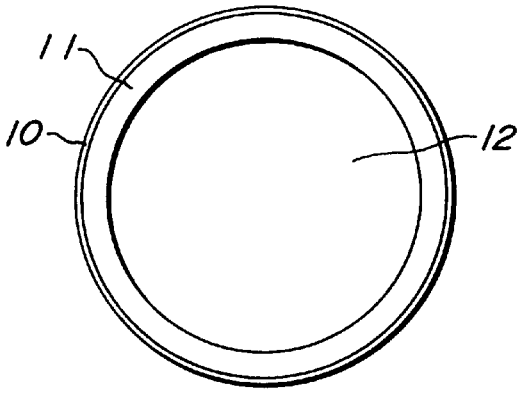
FIG 3 PRIOR ART
FIG. 3 is a schematically section view of the conventional chain link.

Therefore, each of the chain links according to the invention comprises a surface-hardened layer of high carbon tempered martensite structure and a core layer of low carbon tempered martensite structure because the intergranular oxidation as shown in FIG. 4 is not caused and hence the outermost surface layer 10 as shown in FIG. 3 is not existent in the surface layer portion.

The properties of each of the chains of Sample Nos. 6–9 are mentioned as follows:

Chain of Sample No. 6

(1) The toughness of the surface-hardened layer is improved by the addition effect of B because stress creating cracks $\sigma_C$ is 720 MPa and total elongation at breakage E is 12%.

When Samle No. 6 is compared with Sample No. 4, the stress creating cracks $\sigma_C$ is increased by 25% because $\sigma_C$(No. 6)/$\sigma_C$(No. 4)=720/574=1.25. Further, the total elongation at breakage E in Sample No. 6 is higher by 2.5 times or more than those of Sample Nos. 1–4.

(2) The wear resistance is considerably improved.

That is, the wear resisting ratio AW indicating the wear resistance is 4.66 times and 4.28 times of Sample Nos. 2 and 4, respectively, because AW(No. 6)/AW(No. 2)=1.63/0.35=4.66 and AW(No. 6)/AW(No. 4)=1.63/0.381=4.28.

(3) The fatigue resistance is improved.

The fatigue limit $\sigma_B$ indicating the fatigue resistance in Sample No. 6 is higher by 1.44 times that of Sample No. 4 because $\sigma_F$(No. 6)/$\sigma_F$(No. 4)=360/250=1.44.

(4) The stress at breakage (strength) is improved.

The stress at breakage $\sigma_B$ in Sample No. 6 is higher by 1.12 times than that of Sample No. 4 because $\sigma_B$(No. 6)/$\sigma_B$(No. 4)=910/811=1.12.

Chain of Sample No. 7

The surface carbon content $C_S$ is 0.6 wt %, which is lower than the surface carbon content of 0.8 wt % in the conventional chains of Sample Nos. 1–4. This shows that the toughness becomes higher. Furthermore, the stress creating cracks $\sigma_C$ relating to the toughness and the total elongation at breakage E are improved with those of Sample Nos. 1–4. And also, the stress $\sigma_C$ and total elongation E are higher than those of Sample No. 6.

Chains of Sample Nos. 8 and 9

The surface carbon content $C_S$ is 1.2 wt % in Sample No. 8 and 1.0% in Sample No. 9, which are higher than that (0.7 wt %) of Sample No. 6. This shows that the wear resistance becomes higher. That is, Sample Nos. 8 and 9 tend to be used in applications requiring higher wear resistance rather than the toughness by increasing the carbon content in the surface layer portion as compared with those of Sample Nos. 6 and 7.

Particularly, the wear resisting ratio AW of Sample No. 8 is highest among those of Sample Nos. 1–9 and is higher by 4.69 times than that of Sample No. 5 indicating the highest wear resisting ratio among the conventional samples because AW(NO. 8)/AW(No. 5)=1.84/0.392=4.69.

Figure 5:
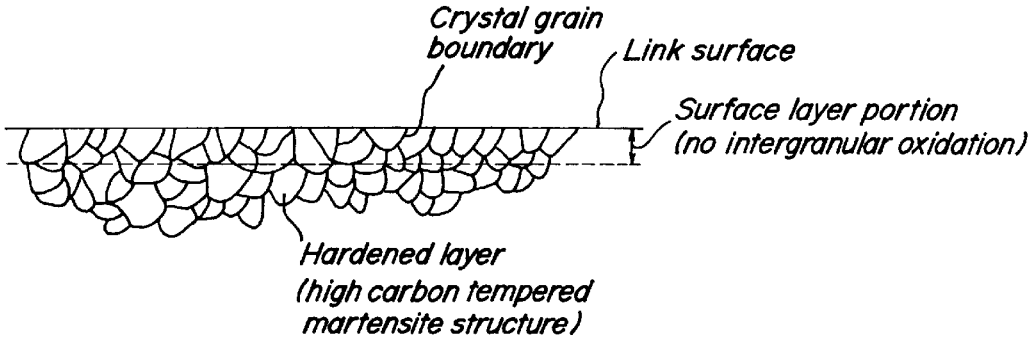
FIG. 5 is a diagrammatically enlarged section view of a structure in a surface portion of the chain link according to the invention.

In FIG. 5 is sectionally shown a structure of a surface-hardened layer of an embodiment of the chain link according to the invention at the same scale as in FIG. 4 showing the structure of the conventional chain link. As seen from FIG. 5, in the chain link according to the invention, the oxidation is not caused at the crystal grain boundary, and the retained austenite is not existent in the surface layer portion, and the austenite grain size becomes fine.

Figure 6:
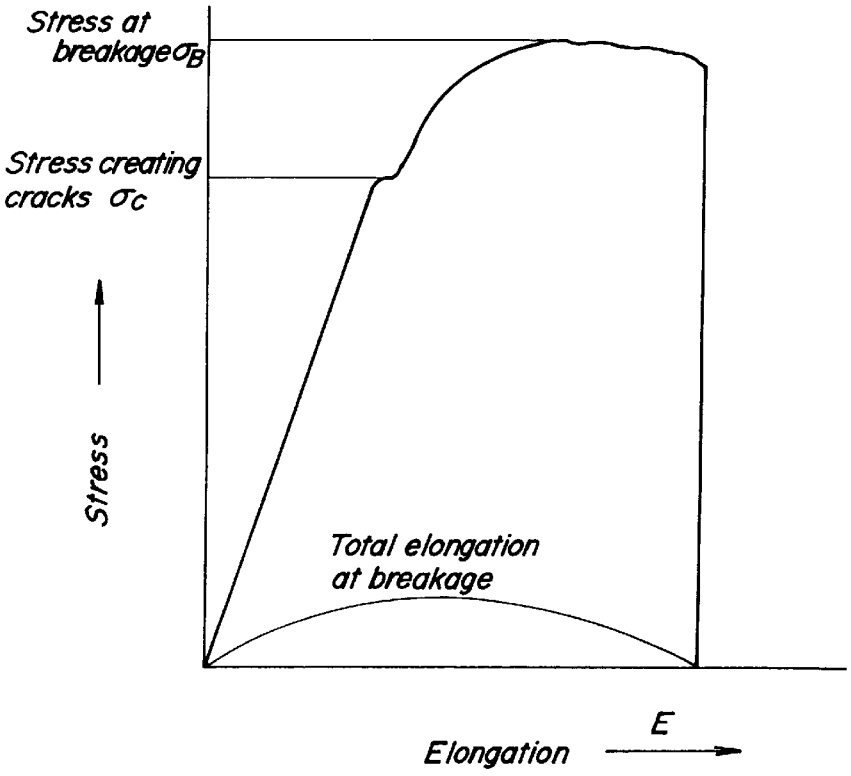
FIG. 6 is a graph showing a relation between tensile stress $\sigma$, applied to the chain link and total elongation E at breakage.

In FIG. 6 is shown a graph showing a relation between tensile stress σ and total elongation at breakage E applied to the chain link, in which $\sigma_C$ is a stress creating cracks and $\sigma_B$ is a stress at breakage and E is represented by the following equation:

$$E=(1-1_0)/1_0$$

wherein $1_0$ is an initial length before the application of tensile stress and 1 is a length after the application of tensile stress.

Figure 7:
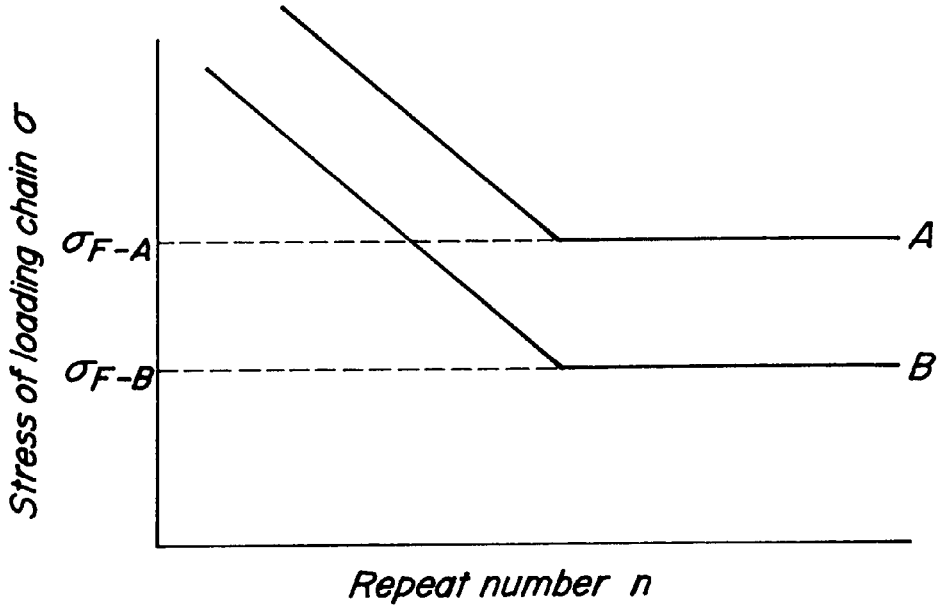
FIG. 7 is a graph showing a result of a fatigue test for a surface-hardened chain.
Figure 8:
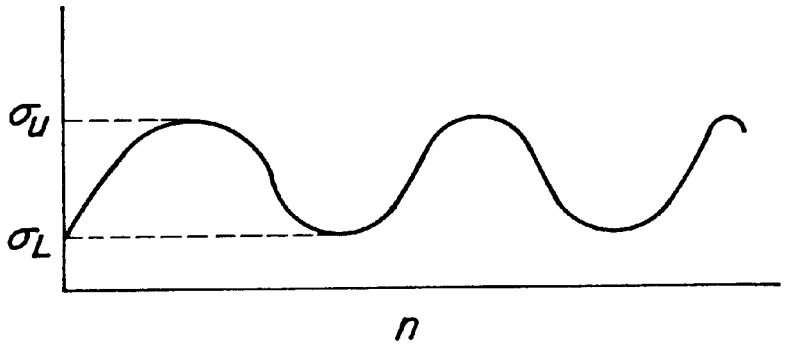
FIG. 8 is a graph showing a relation between tensile stress $\sigma$ varied from an upper limit tensile stress $\sigma_u$ to a lower limit tensile stress $\sigma_L$ and repeat number n.

In FIG. 7 is shown a graph showing results based on a fatigue test of a surface-hardened chain. This graph shows a relation between stress of loading chain σ (i.e. tensile stress of fatigue limit of chain $\sigma_F$) and repeat number n when tensile stress σ applied to the chain link is varied between upper limit tensile stress $\sigma_U$ and lower limit tensile stress $\sigma_L$ as shown in FIG. 8.

A curve A ($\sigma_{F\text{-}A}$) shows the result of the surface-hardened chain according to the invention, and a curve B ($\sigma_{F\text{-}B}$) shows the result of the conventional surface-hardened chain.

For example, when $\sigma_L$=50 MPa, the fatigue limit $\sigma_{F\text{-}A}$ of the surface-hardened chain according to the invention is 360 MPa, while the fatigue limit $\sigma_{F\text{-}B}$ of the conventional surface-hardened chain is 250 MPa.

Figure 9:
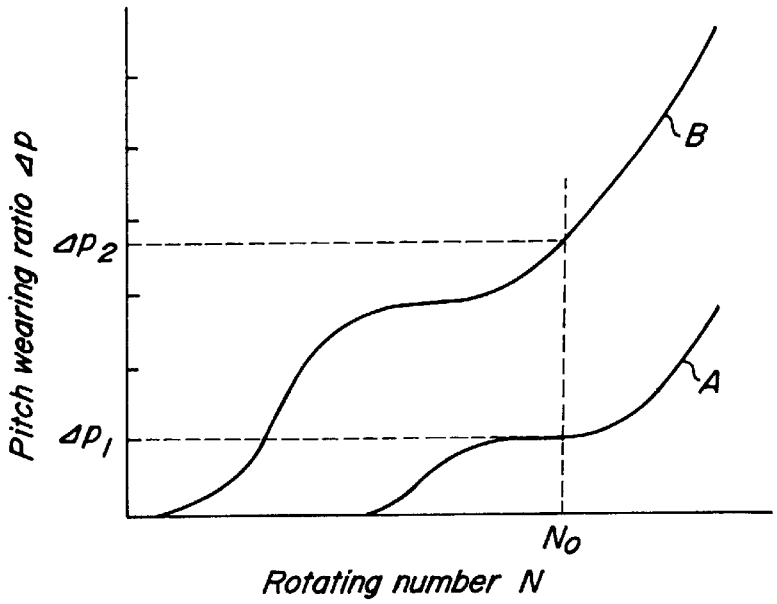
FIG. 9 is a graph showing a relation between chain rotating number N and pitch wearing ratio $\Delta p$ in a test for evaluating a wear resistance of a surface-hardened chain.

In FIG. 9 is shown a graph showing a relation between chain rotating number N and pitch wearing ratio Δp in a test for the wear resistance of a surface-hardened chain, in which a curve A shows the result of the surface-hardened chain according to the invention, and a curve B shows the result of the conventional surface-hardened chain, and N is a rotating number between chain links in the test (N=2m when lifting-up and lifting-down number of electric chain block is m), and $N_0$ is a rotating number defined in the test, and Δp is represented by the following equation:

$$\Delta p=(p-p_0)/p_0\times 100(\%)$$

wherein $p_0$ is an initial pitch of the chain link and p is a pitch of the chain link after the test. Further, the wear resisting ratio AW is defined by AW=1/Δp, in which the larger the numerical value, the better the wear resistances When $N_0$ is $1\times10^4$ in the chain link having a diameter of 7.1 mm and a pitch of 21 mm, the pitch after the test is 21.08 in the chain link according to the invention ($p_1$) and 21.5 in the conventional chain link ($p_2$). Therefore, in the curve A, $\Delta p_1$=(21.08−21)/21×100=0.381 and A=2.63, while in the curve B, $\Delta p_2$=(21.5−21)/21×100=2.3 and AW=0.42.

Figure 10:
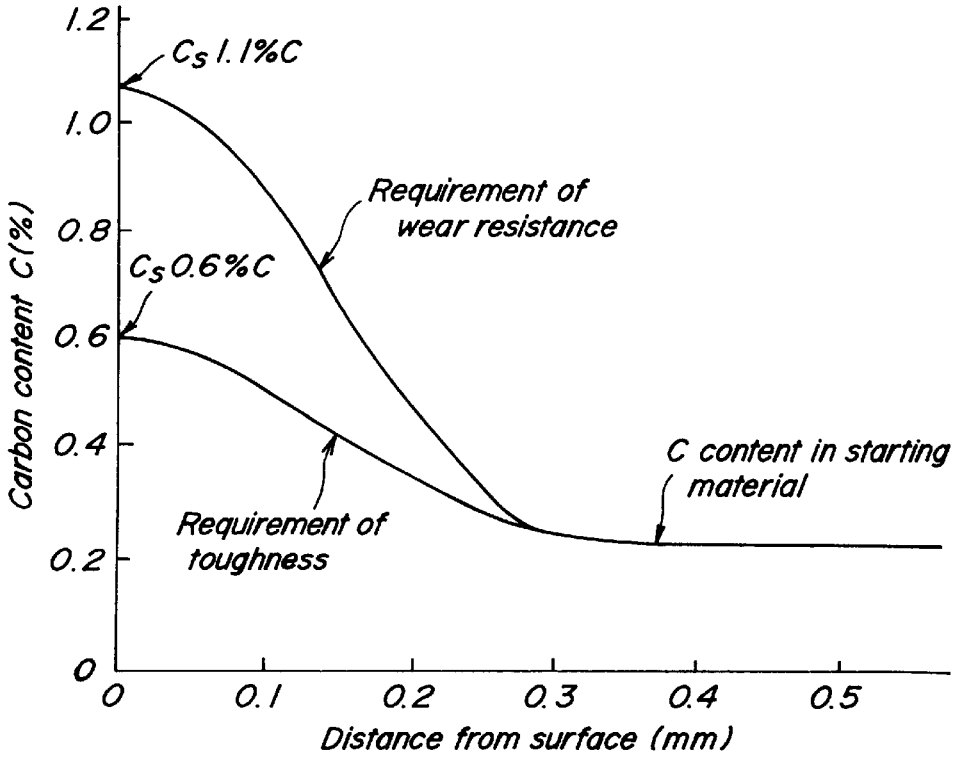
FIG. 10 is a graph showing a distribution of carbon content in a section of a chain link having a diameter of 7.1 mm and a pitch of 21 mm.

In FIG. 10 is shown a distribution of carbon content in a section of a chain link obtained by subjecting a chain link having a carbon content of 0.23 wt %, a diameter of 7.1 n and a pitch of 21 mm to a carburizing so as to provide a surface carbon content $C_S$ of 0.6 wt %, for the application requiring the toughness or 1.1 wt % for the application requiring the wear resistance as an example.

As seen fran the above, the steel of Sample No. 3 corresponding to JP-A-61-276956 has a drawback that the intergranular oxidation is caused in the surface layer portion of the chain link because relatively large amounts of Cr and Mn are existent in addition to B. On the contrary, the steel according to the invention does not cause the intergranular oxidation in the surface portion of the chain link because Cr is not existent and the Mn content is controlled to a level lower than that of Sample No. 3.

As mentioned above, according to the invention, the occurrence of the intergaanular oxidation in the surface layer portion of the chain link during the carburizing, which has been observed in the conventional technique, can effectively be prevented and also the austenite crystal grain size can be made fine, so that there can stably be provided surface-hardened chains having excellent wear resistance, fatigue resistance, toughness and strength.

What is claimed is:

1. A surface-hardened chain comprising a plurality of connected chain links each made from a killed steel having a chemical composition consisting essentially of C: 0.17–0.35 wt %, Si: 0.10–0.25 wt %, Mn: 0.40–0.80 wt %, P: not more than 0.020 wt %, S: not more than 0.020 wt %; Ni: 0.40–1.5 wt %, Mo: 0.15–0.60 wt %, B: 0.0005–0.006 wt % and the balance of Fe, said chain link comprising a surface-hardened layer of a high carbon tempered martensite structure and a core layer of a low carbon tempered martensite structure.

2. A surface-hardened chain according to claim 1, wherein a surface layer portion of the surface-hardened layer has a mtal structure having no oxidation at crystal grain boundary.

3. A surface-hardened chain according to claim 1, wherein an austenite crystal grain size of the chain link is fine.

4. A surface-hardened chain according to claim 2, wherein a carbon content of the surface-hardened layer is a range of 0.6–0.8 wt %.

5. A surface-hardened chain according to claim 2, wherein a carbon content of the surface-hardened layer is a range of 1.0–1.3 wt %.

* * * * *

UNITED STATES PATENT AND TRADEMARK OFFICE

CERTIFICATE OF CORRECTION

PATENT NO. : 5,997,662
DATED : December 7, 1999
INVENTOR(S) : Kanetake Norio

It is certified that error appears in the above-identified patent and that said Letters Patent is hereby corrected as shown below:

Title page,
Item [19]: "Norio" should read -- Kanetake --;
Item [73]: Assignee: "Metal Technic" should read -- Metaltechnic --;
Item [75]: Inventor: "Kanetake Norio" should read -- Norio Kanetake --;

Column 1,
Line 27: "SAM8620" should read -- SAE8620 --;
Line 31: "frrm" should read -- from --;

Column 2,
Line 1: "cmprising" should read -- comprising --;
Line 3: "teeeered" should read -- tempered --; and "rartensite" should read -- martensite --;
Line 14: "acccmpanying" should read -- accompanying --;

Column 3,
Line 57: "ipportant" should read -- important --;

Column 4,
Line 13: "maxamm" should read -- maximum --;

Column 6,
Line 34: "Samle" should read -- Sample --;

UNITED STATES PATENT AND TRADEMARK OFFICE

CERTIFICATE OF CORRECTION

PATENT NO. : 5,997,662
DATED : December 7, 1999
INVENTOR(S) : Kanetake Norio

It is certified that error appears in the above-identified patent and that said Letters Patent is hereby corrected as shown below:

Column 8,
Line 7: "A=2.63" should read -- AW=2.63 --;
Line 17: "fran" should read -- from --;
Line 28: "intergaanular" should read -- intergranular --;
Line 50: "mtal" should read -- metal --.

Signed and Sealed this

Eighteenth Day of September, 2001

*Attest:*

Nicholas P. Godici

*Attesting Officer*

NICHOLAS P. GODICI
*Acting Director of the United States Patent and Trademark Office*